US005967301A

United States Patent [19]

Reed et al.

[11] Patent Number: 5,967,301

[45] Date of Patent: Oct. 19, 1999

[54] POPOUT CONTROL ASSEMBLY FOR RADIOS

[75] Inventors: Thurman Russell Reed, Indianapolis, Ind.; John Patrick Absmeier, Ventura, Calif.

[73] Assignee: Delco Electronics Corporation, Kokomo, Ind.

[21] Appl. No.: 09/032,464

[22] Filed: Feb. 27, 1998

[51] Int. Cl.[6] ..... H01H 19/14

[52] U.S. Cl. ..... 200/523; 74/553; 200/566; 200/526

[58] Field of Search ..... 200/526, 527, 200/523, 564, 566, 336; 74/553, 554, 547

[56] References Cited

U.S. PATENT DOCUMENTS

| | | | |
|---|---|---|---|
| 3,100,404 | 8/1963 | Boeddeker et al. | 74/553 |
| 3,512,427 | 5/1970 | Metcalf | 200/526 X |
| 3,557,637 | 1/1971 | Tomczak | 74/553 |
| 4,365,231 | 12/1982 | Nishioka | 200/336 X |
| 5,384,442 | 1/1995 | Danner | 200/566 |

*Primary Examiner*—Renee S. Luebke
*Attorney, Agent, or Firm*—Jimmy L. Funke

[57] ABSTRACT

A radio keyboard supports a potentiometer on its rear surface and a popout control in the front surface. The control includes a housing between the keyboard and the radio trim plate, inner and outer stationary cams, and a rotatable cam follower on a shaft which controls the potentiometer. The cams index the cam follower each time a knob on the shaft outer end is depressed. The cams alternately hold the follower and the shaft in retracted and extended position.

9 Claims, 3 Drawing Sheets

POPOUT CONTROL ASSEMBLY FOR RADIOS

FIELD OF THE INVENTION

This invention relates to radio control buttons and particularly to popout controls and popout control assemblies.

BACKGROUND OF THE INVENTION

It is often desired to maintain a radio control button in a retracted position during standby mode and then to extend the button for operating mode so that it is easy to manipulate. Such buttons are called popout controls. Usually this is accomplished by a dual position arrangement wherein the button mode is changed by pressing in and then releasing the button so that it alternately assumes a retracted position and an extended position.

A common arrangement for popout controls is shown in FIG. 1. There an open-fronted radio case 10 contains a main circuit board 12 in a horizontal plane, and a vertical keyboard 14 is supported outside the case by a front plate 16 which closes the front of the case. A trim plate 18 covers the front of the radio assembly and includes apertures for operating controls including pushbuttons 19 which connect to the keyboard. A plurality of popout controls 20 within the case 10 are mounted on a horizontal auxiliary board 22 and each control 20 has a threaded tubular part 24 which protrudes through the front plate 16 and is held in place by a nut 28. Each popout control comprises a shaft 30 extending through the trim plate 18 and having a knob 32, and a potentiometer packaged with a dual position arrangement 33 on the board 22 to control the shaft and knob position between a retracted position shown in solid lines and an extended position shown in dashed lines. The auxiliary board 22 is coupled to the main board by a cable 34 and connector 36, and the keyboard 14 is similarly coupled to the main board by a cable 38 and a connector 40. This arrangement has the drawbacks of requiring many parts such as the auxiliary board, cable and connectors required to provide the popout function and the space required in the radio case for those parts.

Commercially available popout controls lack stable support of the shaft 30. That is, when the knob is in extended position the knob can wobble from side to side. Further those controls must be assembled separately from the radio circuit boards and then later assembled into the radio. Generally prior popout controls employ a fixed follower which is engaged by a movable cam profile on a shaft which affects the linear position of the shaft.

SUMMARY OF THE INVENTION

It is therefore an object of the invention to minimize the number of parts and the expense of radio popout controls. Another object is to integrate the popout control with the keyboard.

The invention is carried out by mounting a popout control directly on the keyboard with a cam mechanism situated between the keyboard and the trim plate and a potentiometer on the opposite side of the keyboard. This eliminates the intrusion of the popout control into the radio case as well as a number of parts. In addition an improved dual position mechanism is provided which comprises a cam mechanism coupled to the keyboard such that the keyboard becomes an integral part of the mechanism. A cam housing includes a cylindrical body and a cap, each defining a fixed cam surface. Hooks on the body engage the keyboard to hold the housing body and cap to the keyboard so that no separate fasteners are required. A potentiometer is mounted on the opposite side of the keyboard and is rotatably controlled by a shaft which extends through the housing and supports an external control knob. A cam follower in the housing between the cams is attached to the shaft for rotary and linear movement and is positioned to coact with the cams to determine the shaft linear postion. The shaft rotates independently of the follower. A coil spring is trapped between the cam follower and the keyboard to urge the shaft outward.

BRIEF DESCRIPTION OF THE DRAWINGS

The above and other advantages of the invention will become more apparent from the following description taken in conjunction with the accompanying drawings wherein like references refer to like parts and wherein.

DESCRIPTION OF THE INVENTION

Figure 1:
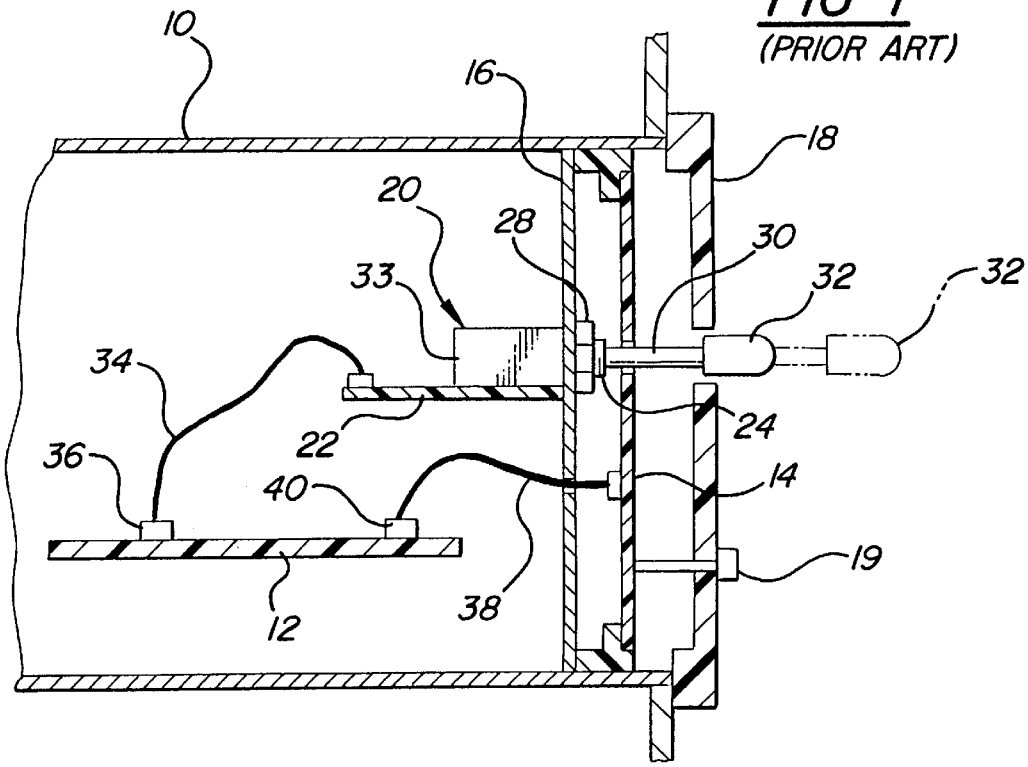
FIG-1 (PRIOR ART)
FIG. 1 is a schematic diagram of a radio cross section including popout controls according to the prior art.
Figure 2:
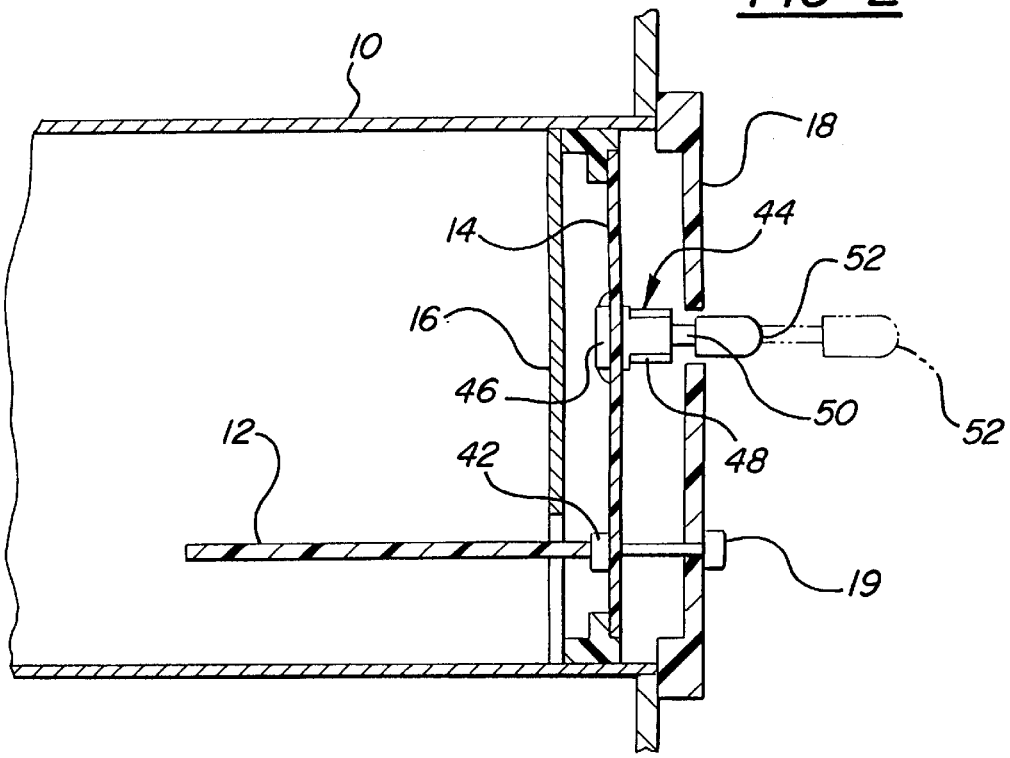
FIG. 2 is a schematic diagram of a radio cross section including popout controls according to the invention.

Referring to FIG. 2, an open-fronted radio case 10 contains a main circuit board 12 in a horizontal plane, and a vertical keyboard 14 is supported outside the case by a front plate 16 which closes the front of the case. The main board connects directly to the keyboard via a board-to-board connector 42 thereby eliminating any cable connections. A trim plate 18 covers the front of the radio assembly and includes apertures for operating controls including pushbuttons 19 which connect to the keyboard 14. A plurality of popout controls 44 are mounted directly to the keyboard and thus reside outside of the case 10. Each popout control 44 comprises a potentiometer 46 or other controlled device on the rear surface of the keyboard, a housing 48 attached to the front side of the keyboard, a rotary and axially movable shaft 50 which couples with the potentiometer 46 and extends through the housing and through the trim plate 18 to support a control knob 52. The keyboard itself is also a part of the popout control since it is used in holding the control parts in assembly. The popout control 44, like the prior art device of FIG. 1, allows the knob 52 to be moved between a retracted position shown in solid lines and an extended position shown in dashed lines.

Figure 3:
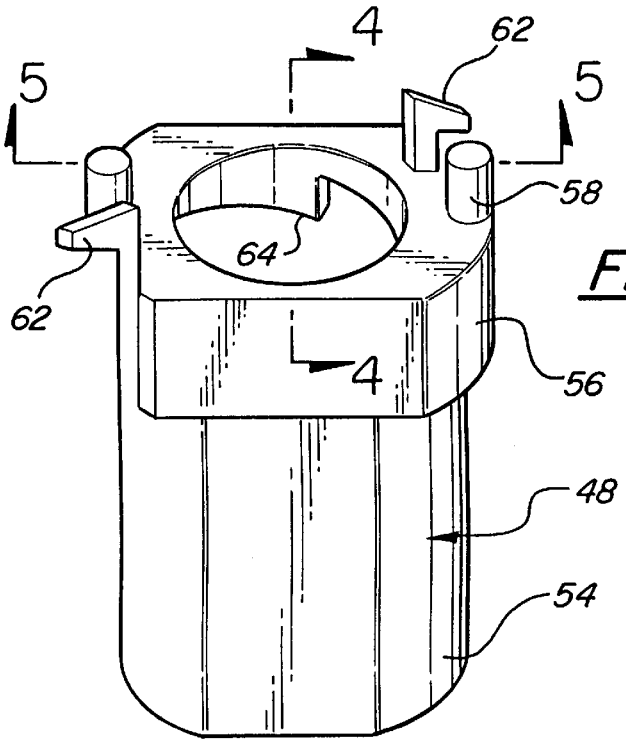
FIG. 3 is an isometric view of a popout control housing according to the invention.
Figure 4:
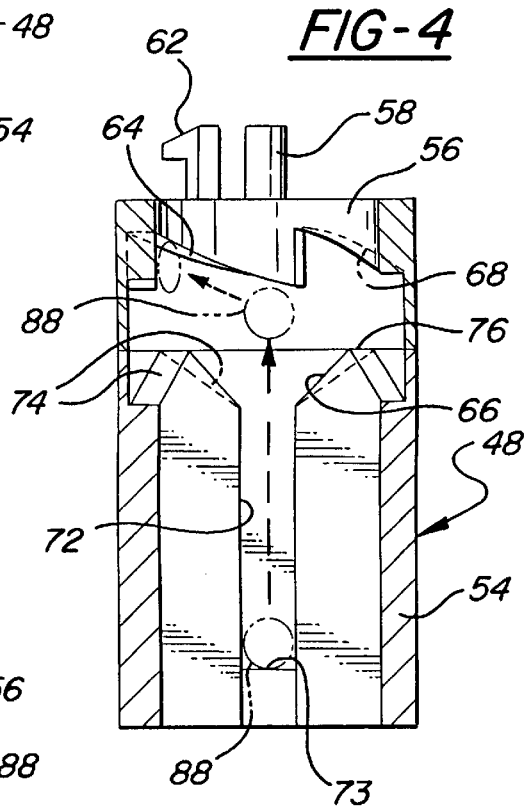
FIG. 4 is a cross section of the popout control housing taken along line 4—4 of FIG. 3.
Figure 5:
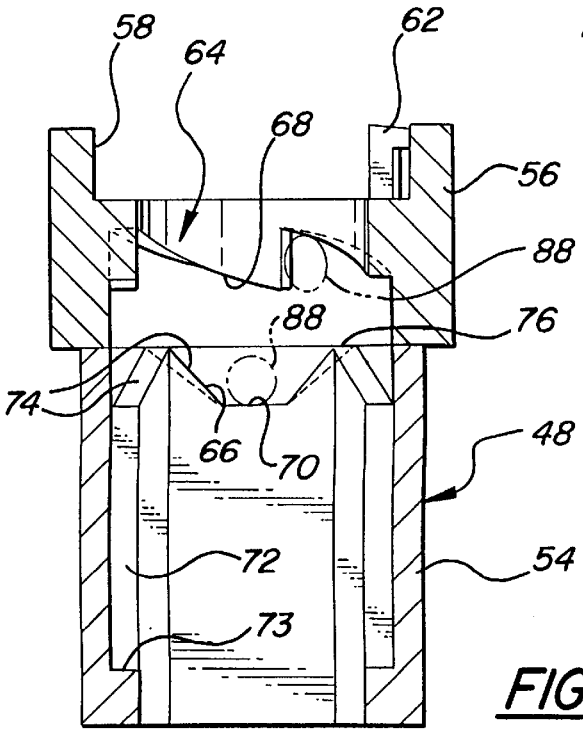
FIG. 5 is a cross section of the popout control housing taken along line 5—5 of FIG. 3.
Figure 6:
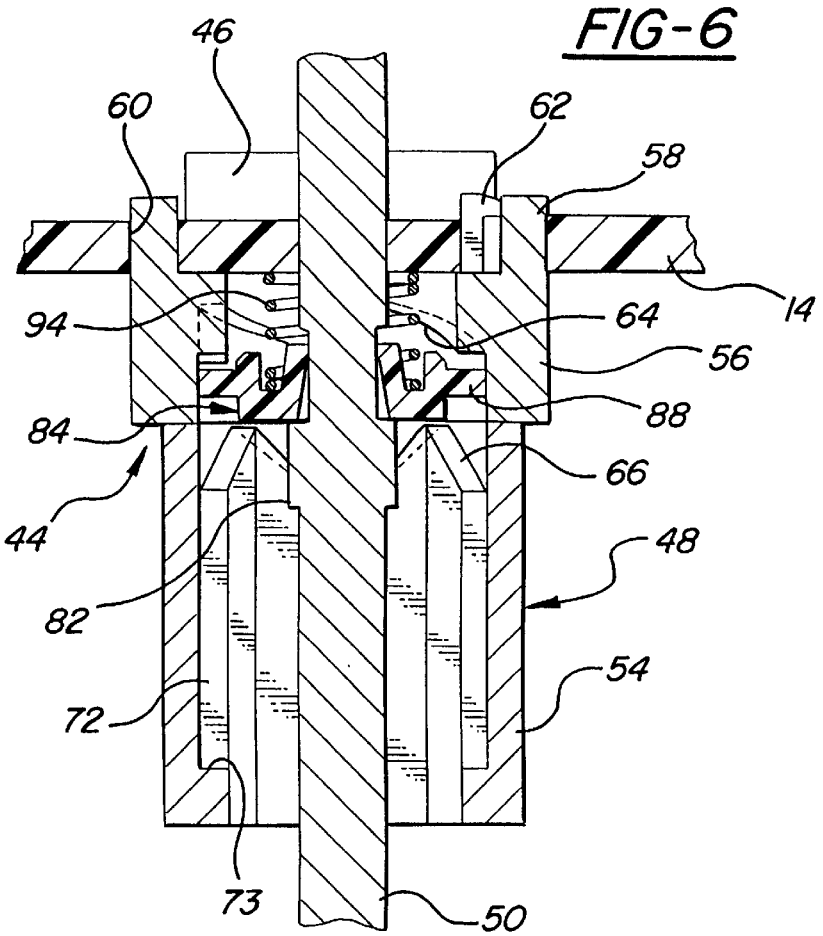
FIG. 6 is a cross section of a popout control assembly according to the invention.

FIGS. 3, 4 and 5 show the stationary housing 48 of the popout control 44 and FIG. 6 shows the housing in the control assembly. The outer part of the housing (nearest the trim plate) is a generally cylindrical body 54 and the inner part is a cap 56. The cap has a pair of protruding locating pins 58 for engaging mating apertures 60 in the keyboard 14. The body 54 has a pair of hooks 62 extending past the cap to engage apertures in the keyboard to hold the housing 48 to the keyboard when assembled and to trap the cap 56 between the keyboard and the body 54.

The cap 56 contains a fixed inner cam 64 axially spaced from an outer cam 66 in the body 54. The cam 64 comprises four ramps 68 facing the cam 66. The cam 66 defines a pair of shallow cradles 70 on opposite sides of the body to form an inner stop and a pair of long guide tracks 72 oriented 90° from the cradles each closed at the outer end to form an outer stop 73. Short ramps 74 forming peaks 76 pointed toward the cam 64 bridge the cradles 70 and tracks 72.

Figure 8:
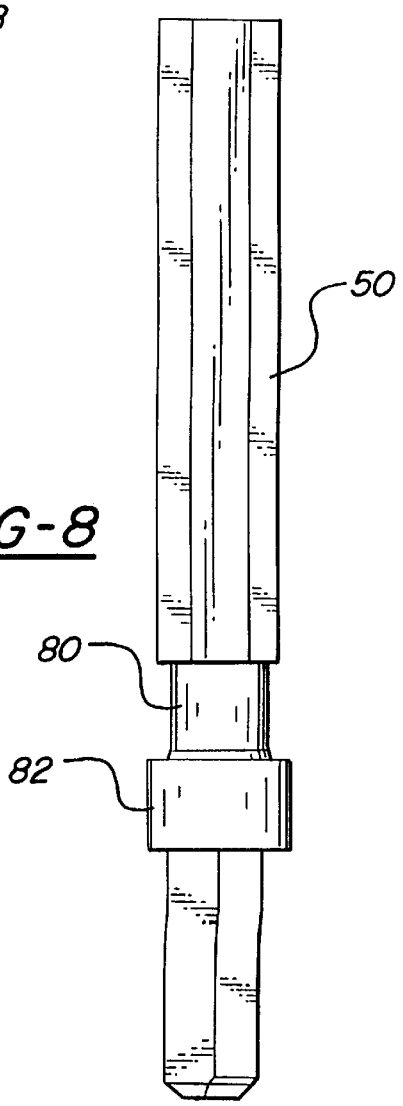
FIG. 8 is an isometric view of a cam follower of the assembly of FIG. 6.
Figure 7:
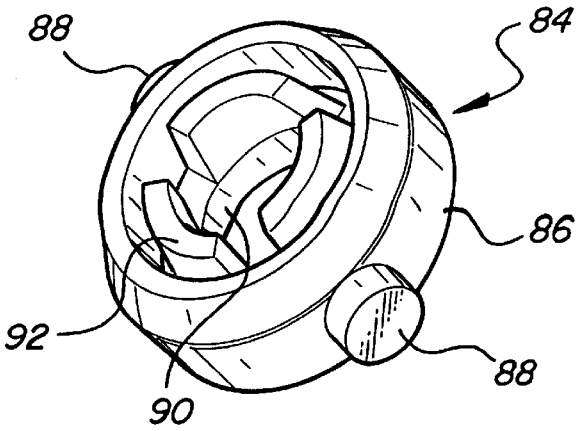
FIG. 7 is a side view of a shaft of the assembly of FIG. 6.

The shaft 50, shown in FIG. 7, has a generally hex shaped cross section and includes a reduced neck 80 of circular cross section and an adjacent shoulder 82 of greater diameter than the remainder of the shaft. FIG. 8 shows a cam follower 84 having an annular body 86 and two ears 88 extending from opposite sides of the body. The body 86 has a central circular aperture 90 ringed by three flexible inner flanges 92. The free ends of the flanges define a diameter matching that of the reduced neck 80. The follower is assembled to the shaft by sliding until it reaches the shoulder 82. The flanges 92, flexed during the sliding operation, snap into the reduced neck, as shown in FIG. 6, to hold the follower on the shaft adjacent the shoulder and to allow free rotation on the shaft.

Referring again to FIG. 6, the assembly 44 comprises the follower 84 on the shaft 50 enclosed in the housing 48. The ears 88 extend radially outward adjacent the cams to slide along the inner surface of the housing to lend lateral stability to the shaft. The shaft also slides within the potentiometer 46 which is attached to the opposite side of the keyboard to afford a second site of shaft stabilization axially spaced from the follower. A compressed coil spring 94 is seated at one end against the keyboard 14 and at the other end against the follower in a recess between the annular body 86 and the flanges 92 to urge the follower and the shaft outward.

In operation, the follower ears 88 move along the cam surfaces to determine follower position axially as well as angularly. The ears 88 reach the outer end of the tracks 72 when the shaft and knob are fully extended as indicated in FIG. 4. When the knob is manually depressed to force the follower inward, along the ramp thereby rotating or indexing the follower about 70°. When the knob is released the follower moves outward under spring force as shown in FIG. 5 to engage a ramp 74 and ride down into the cradle 70, rotating about 20°, where it remains to hold the shaft and knob in retracted position. When the knob is again manually depressed the process is repeated to index the follower another 90° allow the ears to enter the track 72 again and the spring 94 pushes the shaft to the extended position.

It will thus be seen that the cam mechanism integrated with the keyboard affords substantial economies by eliminating several parts and improving reliability by minimizing the number of connections. In addition, space requirements in the radio case are substantially reduced.

The embodiments of the invention in which an exclusive property or privilege is claimed are defined as follows:

1. A radio popout control assembly comprising:

a keyboard;

an external trim plate parallel to the keyboard;

a rotary control device on the keyboard for rotation about an axis perpendicular to the keyboard; and a popout control mounted to the keyboard and having a rotary shaft on the axis coupled to the control device and extending to the trim plate, a knob on the shaft extending through an aperture in the trim plate, a spring biasing the shaft toward the trim plate, and cam means responsive to axial depression of the shaft for moving the knob alternately between extended and retracted positions, such cam means including:

a cam follower rotatably attached to the shaft for axial movement therewith;

an inner cam for engaging the follower and indexing the follower alternately between first and second angular orientations when the shaft is depressed to engage the follower with the inner cam; and an outer cam having a first stop engaging the follower in the first angular orientation for holding the cam follower and the shaft in retracted position and a second stop engaging the follower in the second angular orientation for holding the cam follower and the shaft in extended position.

2. A radio popout control assembly comprising:

a keyboard;

an external trim plate parallel to the keyboard;

a rotary control device on the keyboard for rotation about an axis perpendicular to the keyboard; and a popout control mounted to the keyboard and having a rotary shaft on the axis coupled to the control device and extending to the trim plate, a knob on the shaft extending through an aperture in the trim plate, a spring a biasing the shaft toward the trim plate and cam means responsive to axial depression of the shaft for moving the knob alternately between extended and retracted positions, such cam means including:

a generally cylindrical housing concentric with the shaft between the keyboard and the trim plate defining an inner cam adjacent the keyboard and an outer cam adjacent the trim plate;

a cam follower axially fixed to and rotatably mounted on the shaft and disposed in the housing between the inner and outer cams for alternate engagement with the cams as the shaft is moved axially;

the inner cam being shaped to partially index the follower alternately between first and second angular orientations; and the outer cam being shaped to fully index the follower to a respective angular orientation, and to hold the shaft in the retracted position when in the first angular orientation and to hold the shaft in the extended position when in the second angular position.

3. An assembly as defined in claim 2 wherein the cam follower slidably engages an inner surface of the housing to laterally support the shaft in the housing.

4. An assembly as defined in claim 2 wherein:

the cam follower slidably engages an inner surface of the housing to laterally support the shaft in the housing; and the shaft slidably engages the rotary control device at a position axially spaced from the cam follower to further laterally support the shaft.

5. A radio popout control assembly comprising:

a keyboard;

an external trim plate parallel to the keyboard;

a rotary control device on the keyboard for rotation about an axis perpendicular to the keyboard; and a popout control mounted to the keyboard and having a rotary shaft on the axis coupled to the control device and extending to the trim plate a knob on the shaft extending through an aperture in the trim plate a spring biasing the shaft toward the trim plate, and cam means responsive to axial depression of the shaft for moving the knob alternately between extended and retracted positions, such cam means including:

a generally cylindrical housing concentric with the shaft situated between the keyboard and the trim plate comprising a body portion adjacent the trim plate defining an outer cam, and a cap adjacent the keyboard defining an inner cam; and a plurality of attachment hooks extending from the body portion and passing beyond the cap through apertures formed in the keyboard adjacent the rotary control device, the attachment hooks engaging the keyboard to retain the body portion and cap with respect to the keyboard.

6. A popout control assembly for an automotive radio for moving a rotatable control knob between a retracted and an extended position comprising:

an elongated housing;

a rotatable and axially movable shaft mounted in the housing and having one end extending from the housing to support a control knob;

a cam follower rotatably attached to the shaft for axial movement therewith;

an inner cam in the housing for engaging the follower and indexing the follower alternately between first and second angular orientations when the shaft is depressed to engage the follower with the inner cam;

an outer cam in the housing having a first stop engaging the follower in the first angular orientation for holding the cam follower and the shaft in retracted position and a second stop engaging the follower in the second angular orientation for holding the cam follower and the shaft in extended position; and means for biasing the shaft toward the extended position.

7. A popout control assembly as defined in claim 6 wherein:

the housing comprises a cap defining an inner cam, and a generally cylindrical body concentric with the shaft defining the outer cam and having attachment hooks extending axially from the body beyond the cap; and the control includes a circuit board adjacent the cap with apertures receiving the attachment hooks whereby the body and cap are secured to the circuit board.

8. A popout control assembly for an automotive radio for moving a rotatable control knob between a retracted and an extended position comprising:

a generally cylindrical housing defining an inner cam and an outer cam;

a rotatable and axially movable shaft mounted in the housing and having one end extending from the housing to support a control knob;

a cam follower axially fixed to and rotatably mounted on the shaft and disposed in the housing between the inner and outer cams for alternate engagement with the cams as the shaft is moved axially;

the inner cam being shaped to partially index the follower alternately between first and second angular orientations; and the outer cam being shaped to fully index the follower to a respective angular orientation, and to hold the shaft in the retracted position when in the first angular orientation and to hold the shaft in the extended position when in the second angular position.

9. The control assembly as defined in claim 8 wherein the cam follower slidably engages an inner surface of the housing to laterally support the shaft in the housing.

* * * * *